US010350476B2

(12) United States Patent
Lee et al.

(10) Patent No.: US 10,350,476 B2
(45) Date of Patent: Jul. 16, 2019

(54) SCREEN BASEBALL SYSTEM INCLUDING SCREEN SHUTTER

(71) Applicant: REALYAGU ZONE CO. LTD., Seoul (KR)

(72) Inventors: Seung Jin Lee, Seoul (KR); Han Jo Kwon, Seoul (KR); Hyoung Gon Kim, Seoul (KR)

(73) Assignee: REALYAGU ZONE CO., LTD. (KR)

( * ) Notice: Subject to any disclaimer, the term of this patent is extended or adjusted under 35 U.S.C. 154(b) by 0 days.

(21) Appl. No.: 15/695,674

(22) Filed: Sep. 5, 2017

(65) Prior Publication Data

US 2018/0065020 A1 Mar. 8, 2018

(30) Foreign Application Priority Data

Sep. 7, 2016 (KR) ..... 10-2016-0115037

(51) Int. Cl.
*A63B 69/00* (2006.01)
*A63B 69/40* (2006.01)
(Continued)

(52) U.S. Cl.
CPC ..... *A63B 69/406* (2013.01); *A63B 69/0002* (2013.01); *A63B 71/0054* (2013.01); *A63B 71/06* (2013.01); *A63B 71/0622* (2013.01); *A63B 24/00* (2013.01); *A63B 69/40* (2013.01); *A63B 71/022* (2013.01); *A63B 2024/0034* (2013.01); *A63B 2069/0008* (2013.01); *A63B 2069/401* (2013.01); *A63B 2069/402* (2013.01); *A63B 2071/0625* (2013.01); *A63B 2220/10* (2013.01); *A63B 2220/30* (2013.01); *A63B 2220/801* (2013.01)

(58) Field of Classification Search
CPC ..... A63B 69/406; A63B 69/0002; A63B 71/0054; A63B 71/06; A63B 71/0622; A63B 24/00; A63B 69/40; A63B 71/022; A63B 2024/0034; A63B 2069/0008; A63B 2069/401; A63B 2069/402; A63B 2071/0625; A63B 2220/10; A63B 2220/30; A63B 2220/801
USPC ..... 473/421, 422, 451; 124/41.1, 7, 78, 32, 124/34
See application file for complete search history.

(56) References Cited

U.S. PATENT DOCUMENTS 1,198,300 A * 9/1916 Watkins ..... A63B 69/406 124/41.1
4,442,823 A * 4/1984 Floyd ..... A63B 69/406 473/421
(Continued)

FOREIGN PATENT DOCUMENTS

JP 2002186699 A * 7/2002
KR 1020020018185 A 3/2002
(Continued)

*Primary Examiner* — Mitra Aryanpour
(74) *Attorney, Agent, or Firm* — McNees Wallace & Nurick LLC

(57) ABSTRACT

The present invention provides a screen baseball system including a pitching machine that shoots a baseball, a screen, having a screen hole through which the baseball passes, and a screen shutter including a safety screen configured to close the screen hole. The present invention can fundamentally prevent a safety incident from occurring during a screen baseball game.

7 Claims, 9 Drawing Sheets

(51) Int. Cl.

| | |
|---|---|
| ***A63B 71/06*** | (2006.01) |
| ***A63B 71/00*** | (2006.01) |
| *A63B 71/02* | (2006.01) |
| *A63B 24/00* | (2006.01) |

(56) References Cited

U.S. PATENT DOCUMENTS 4,915,384 A * 4/1990 Bear ..... A63B 24/0021 473/451
5,174,565 A * 12/1992 Komori ..... A63B 69/40 124/7
5,195,744 A * 3/1993 Kapp ..... A63B 69/406 473/451
5,984,810 A * 11/1999 Frye ..... A63B 24/0021 473/422
6,082,350 A * 7/2000 Crews ..... A63B 47/00 124/78
6,102,021 A * 8/2000 Sanders ..... A63B 24/0003 124/78
6,443,140 B1 * 9/2002 Crews ..... A63B 47/00 124/78
6,513,512 B2 2/2003 Battersby et al.
6,675,792 B2 * 1/2004 Suba ..... A63B 69/0002 124/32
6,820,605 B1 * 11/2004 Suba ..... A63B 69/408 124/34
7,413,521 B2 * 8/2008 Cherry ..... A63B 71/022 473/451
8,496,545 B2 * 7/2013 Lay ..... A63B 71/022 124/1
8,747,259 B2 6/2014 Lay
9,452,339 B1 * 9/2016 Shah ..... F41B 4/00 473/422
2002/0098920 A1 * 7/2002 Bruyer ..... A63B 71/022 473/421
2003/0195061 A1 * 10/2003 Brown ..... A63B 69/406 473/451
2005/0072417 A1 * 4/2005 Barron, Jr. ..... A63B 69/406 124/78
2007/0021242 A1 * 1/2007 Krickler ..... A63B 24/0021 473/451

FOREIGN PATENT DOCUMENTS

KR 1020120016868 A 2/2012
KR 101543371 B1 8/2015
KR 101546666 B1 8/2015
KR 101572525 B1 11/2015
KR 101572526 B1 12/2015
KR 101573912 B1 12/2015

* cited by examiner

SCREEN BASEBALL SYSTEM INCLUDING SCREEN SHUTTER

TECHNICAL FIELD

The present invention relates to a screen baseball system and, more particularly, to a screen baseball system including a screen shutter to prevent accidents.

BACKGROUND ART

By "screen baseball" it is meant a baseball game that is progressed similarly to an actual baseball game using a screen onto which an image is projected and a pitching machine located on the rear surface of the screen. A user views the projected image while participating in the game.

The screen baseball system, according to the related art, will be described with reference to FIG. 1.

A space of the screen baseball system may be divided into a safety area 100, a game area 200, and a pitching area 300.

The safety area 100 is an area that is distinguished from the game area 200 by a safety net 120 and protected by the safety net 120. A door 125 for coming into or out from the game area 200 is provided in the safety net 120.

A shooting signal device 210, an image unit 220, a sensor 230, and a screen 250, are located in the game area 200.

The shooting signal device 210 is configured to apply a baseball shooting signal to a control unit (not illustrated) when triggered by the user. The shooting signal device 210 may include a pedal. When the user steps on the shooting signal device 210, a baseball is shot.

The image unit 220 receives image information from the control unit, and projects an image onto the screen 250.

The sensor 230 senses the location and the speed of the baseball within the game area 200.

A screen hole 251 is located at the center of the screen 250. The game is played by moving the baseball from a pitching machine 390, through the screen hole 251, at a high speed, toward the user within the game area 200. The user may then attempt to bat the baseball.

The pitching area 300 is distinguished from the game area 200 by the screen 250. The pitching machine 390 is located within the pitching area 300.

While the screen baseball game is being played, a baseball may not be shot, by the pitching machine 390, when the user activates the shooting signal device 210, for various reasons, such as failure or jamming of the pitching machine 390, or running out of baseballs. In this case, because The user may think that no additional baseballs will be shot. The user may begin to move freely in the game area 200. If a baseball is abruptly shot from the pitching machine 390, a safety incident may occur.

A method for preventing a safety incident in a screen baseball system according to the related art-will be described in detail with reference to FIGS. 2 and 3.

In order to begin a screen baseball game, a game start signal is applied to the control unit (S310). The user activates the shooting signal device 210, which sends a baseball shooting signal to the control unit (S320). The control unit operates the pitching machine 390 such that the pitching machine 390 shoots a baseball (S330) into the game area 200. The sensor 230 senses whether the pitching machine 390 has shot the baseball. If the baseball has not been shot, the image unit 220 projects a warning image onto the screen 250 (S340).

An example of the projected warning image is illustrated in FIG. 3. The warning notifies the user of the possibility that a baseball will be shot into the game area 200 and encourages caution. Optionally, a warning sound or the like may be output from a separate speaker (not illustrated).

Thus, in the related art, only the warning image for prevention of a safety accident is projected onto the screen 250. The user may neglect or not recognize the warning image and move freely in the game area 200, allowing a safety incident to occur.

The conventional art related thereto will be described below.

U.S. Pat. No. 7,413,521 discloses a pitching machine including a shooting prevention screen opened using a pulley system only when a baseball is shot. The system does not prevent a baseball from being untimely shot.

U.S. Pat. No. 8,747,259 discloses a safety steel net that may be accurately coupled to a baseball shooting hole of a pitching machine. This net is configured to protect the pitching machine from a batted baseball. The net is not configured to protect a user from a baseball.

U.S. Pat. No. 6,513,512 discloses a screen baseball apparatus including a T-shaped screen hole. The system is not configured to protect a user from an untimely shot baseball.

Technical Problem

The present invention is conceived to solve the following problems.

An aspect of the present invention is to provide a configuration for more effectively preventing a safety incident that may occur in a screen baseball game.

Another aspect of the present invention is to provide a system, which may prevent a safety incident by fundamentally preventing a baseball from being shot into the game area 200, while the user is unprepared.

In particular, another aspect of the present invention is to provide a system, having two or more ways of preventing safety incidents. The system remains operable even when any one component has malfunctioned.

Technical Solution

In order to solve the above-described problems, a screen baseball system is provided. The screen baseball system includes a pitching machine 390, that shoots a baseball, a screen 250 having a screen hole 251, through which a baseball passes, and a screen shutter 350, between the pitching machine 390 and the screen 250, which includes a safety screen 358, configured to close the screen hole 251.

The screen baseball system further includes a shooting signal device 210, that applies a baseball shooting signal to the pitching machine 390 through the control unit. The control unit additionally operates the screen shutter 350 in conjunction with the baseball shooting signal.

The screen shutter 350 may be operated, by the control unit, in any one of a closed state and an open state. In the closed state, the safety screen 358 closes the screen hole 251. In the open state, the safety screen 358 opens the screen hole 251.

During operation, the shooting signal device 210 sends the baseball shooting signal to the control unit. The control unit operates the screen shutter 350, resulting in the screen shutter 350 being in the open state. The control unit also operates the pitching machine 390, such that, the pitching machine 390 shoots a baseball.

The control unit may optionally cause the screen shutter 350 to move to a closed state, after a predetermined period of time in the open state.

During operation the control unit may receive data from the sensors 230. The control unit detects whether the baseball has been shot from the pitching machine 390. If the control unit fails to detect the shooting of the baseball after applying the baseball shooting signal to the pitching machine 390, the control unit operates the screen shutter 350 causing it to move to the closed state. The control unit may additionally cause the image unit 220 to project a first warning message onto the screen 250 to warn a user the pitching machine 390 has not shot the baseball.

If the control unit detects that the baseball has not been shot and the screen shutter 350 is in the open position, the control unit may additionally cause the image unit 220 to project a second warning image onto the screen 250.

In the example of FIG. 6, the screen shutter 350 includes a frame 351. Rotary shafts 352, 353 are positioned within the frame 351. The safety screen 358 is wound on the rotary shafts 352, 353. A pulley 354, 355 is affixed to each of the rotary shafts 352, 353. A timing belt 357 is coaxially coupled to the ends of the rotary shafts 352, 353 via the pulleys 354, 355. The timing belt 357 is wound on the pulleys 354, 355. One or more driving parts 356 are operatively coupling to the pulleys 354, 355. A holding part 359 is additionally affixed to the frame 351.

During operation, one or more driving parts 356 are operated, driving rotation of the pulleys 354, 355 and causing the safety screen 358 to close the screen hole 251. The one or more driving parts 356 may also be operated to drive the rotation of the pulleys 354, 355, to place the shutter 350 in the open state, causing the safety screen 358 to open the screen hole 251. The driving parts 356 may additionally be operated, after a predetermined period of time in the open state, to cause the shutter 350 to move to the closed state, thereby closing the screen hole 251.

Advantageous Effects

According to the present invention, a safety incident during a screen baseball game may be prevented. The present invention may prevent the incident, even if the user does not recognize or heed a warning image. During a screen baseball game, a baseball may not be shot, by the pitching machine 390, when the user activates the shooting signal device 210, various reasons such as failure or jamming of the pitching machine, or running out of baseballs The user may begin to move freely in the game area 200. The present invention prevents a baseball from being abruptly shot from the pitching machine 390, thus preventing a safety incident.

A safety incident may also be prevented if a portion of the screen shutter has malfunctioned. The present invention includes a plurality of drives 356 configured to operate the safety screen 358. The present invention also includes a plurality of warning images, which can alert the user and prevent safety incidents.

DESCRIPTION OF THE INVENTION

Hereinafter, the present invention will be described in detail with reference to the drawings.

Description of a Screen Baseball System

A screen baseball system according to the present invention will be described, with reference to FIGS. 4 and 5.

The screen baseball system according to the present invention is different from the screen baseball system according to the related art, in that the former has a screen shutter 350 provided in a pitching area 300.

Figure 1:
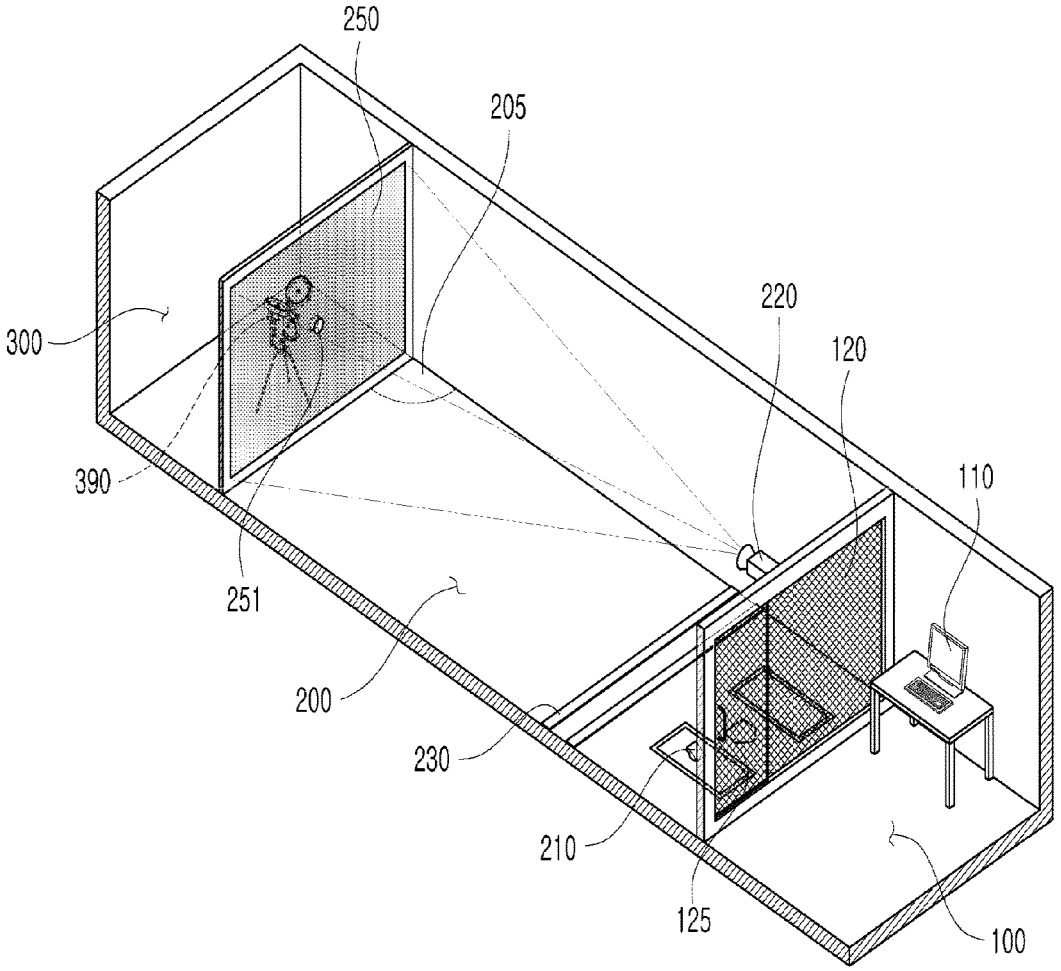
FIG. 1 is a schematic view for describing a screen baseball system, according to the related art.
Figure 2:
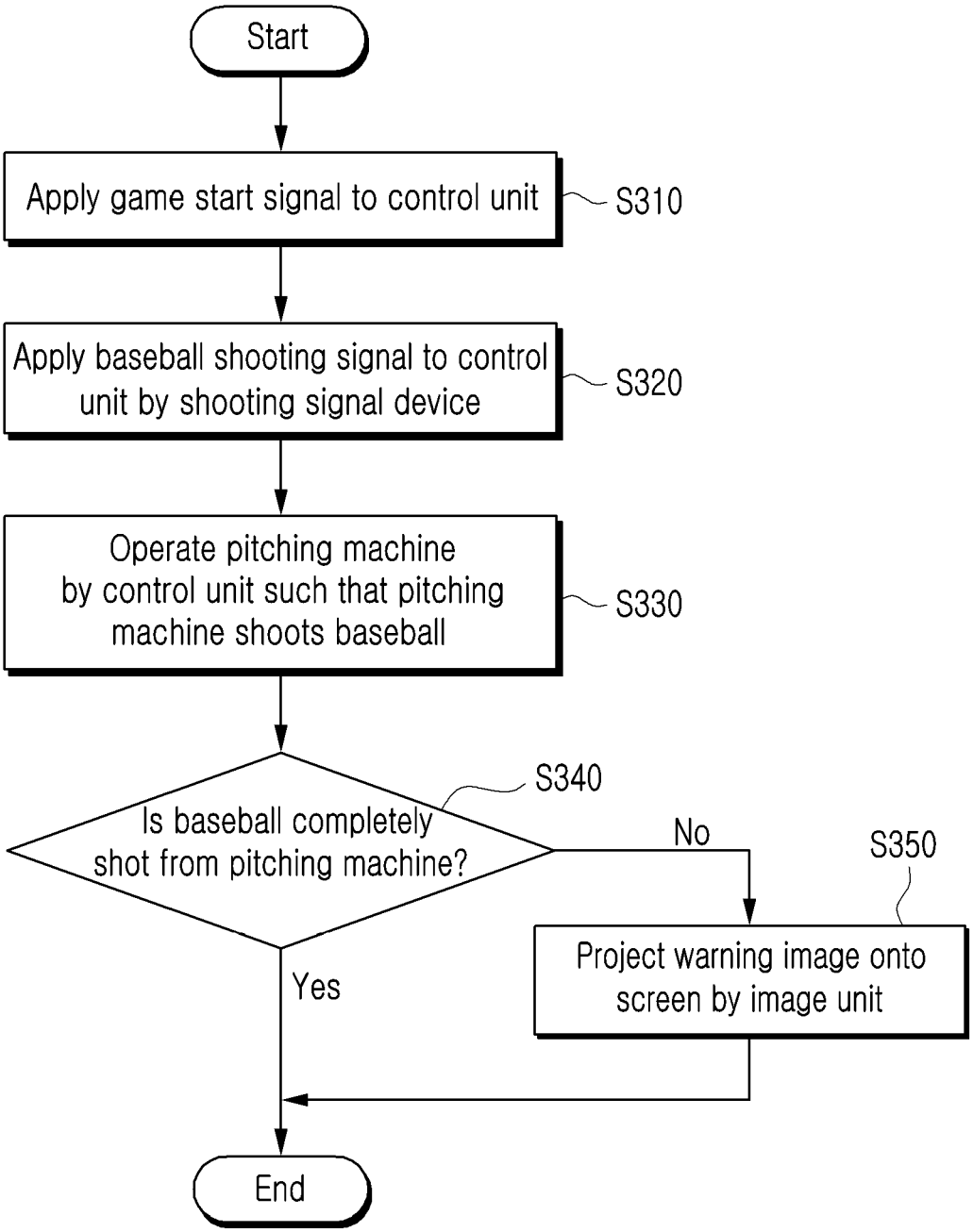
FIG. 2 is a flowchart for describing a method for preventing a safety accident in the screen baseball system, according to the related art.
Figure 3:
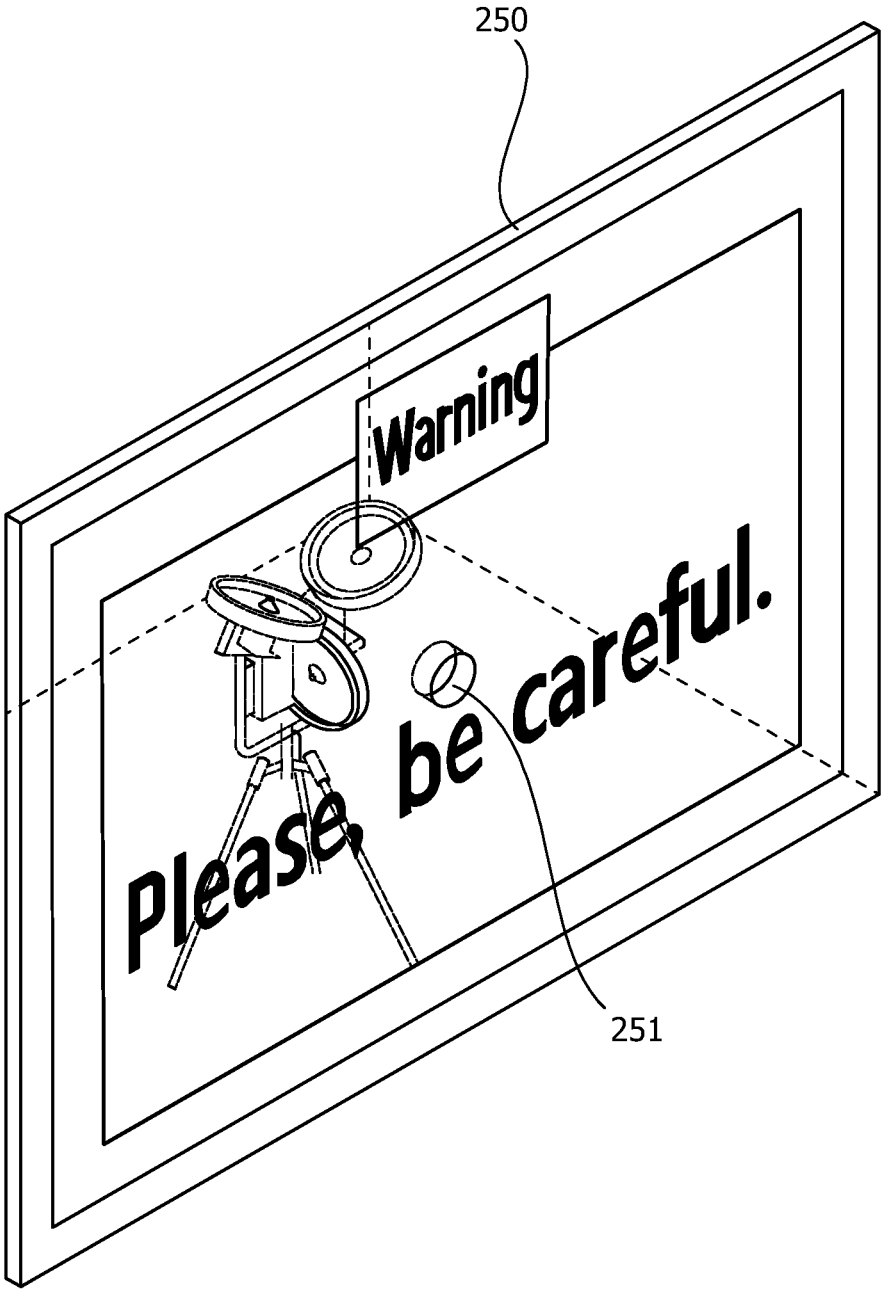
FIG. 3 illustrates a warning image projected to prevent a safety accident in the screen baseball system, according to the related art.
Figure 4:
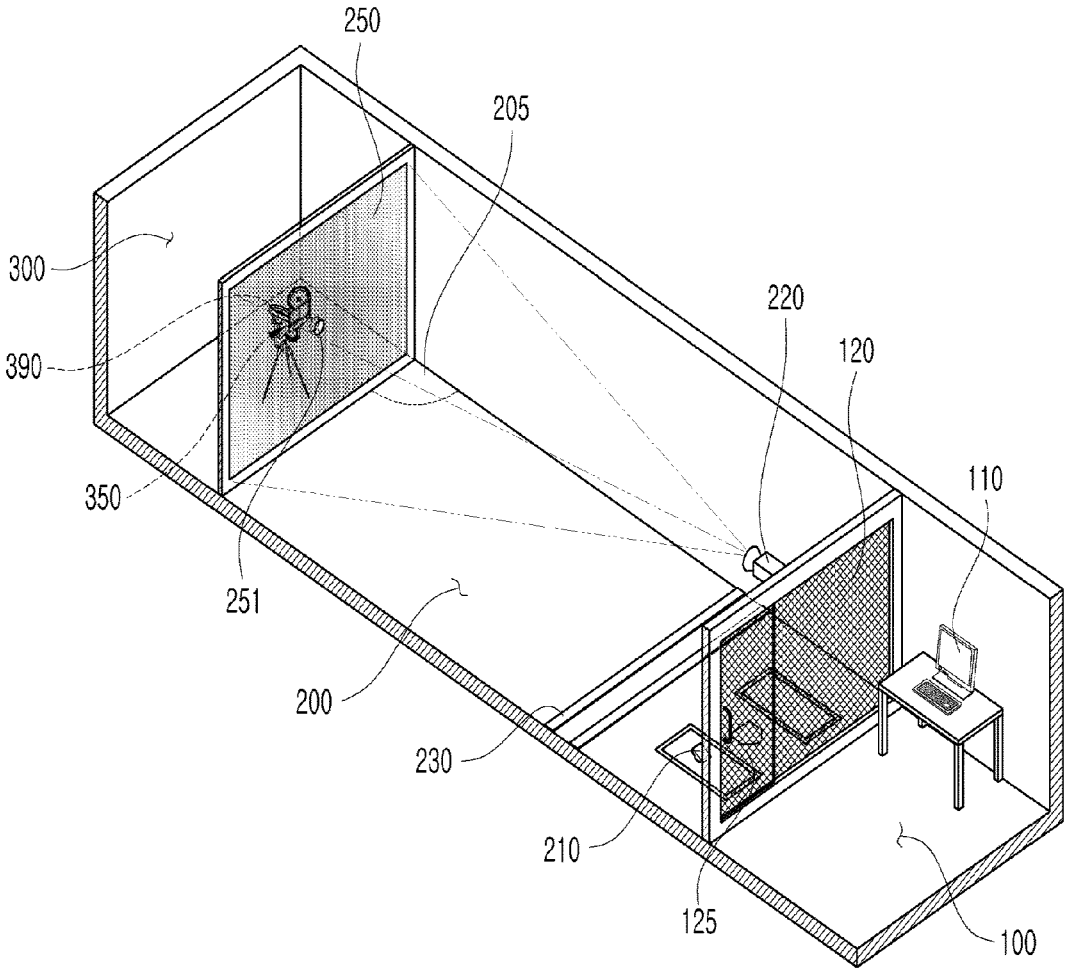
FIG. 4 is a schematic view for describing the screen baseball system, according to the present invention.
Figure 5:
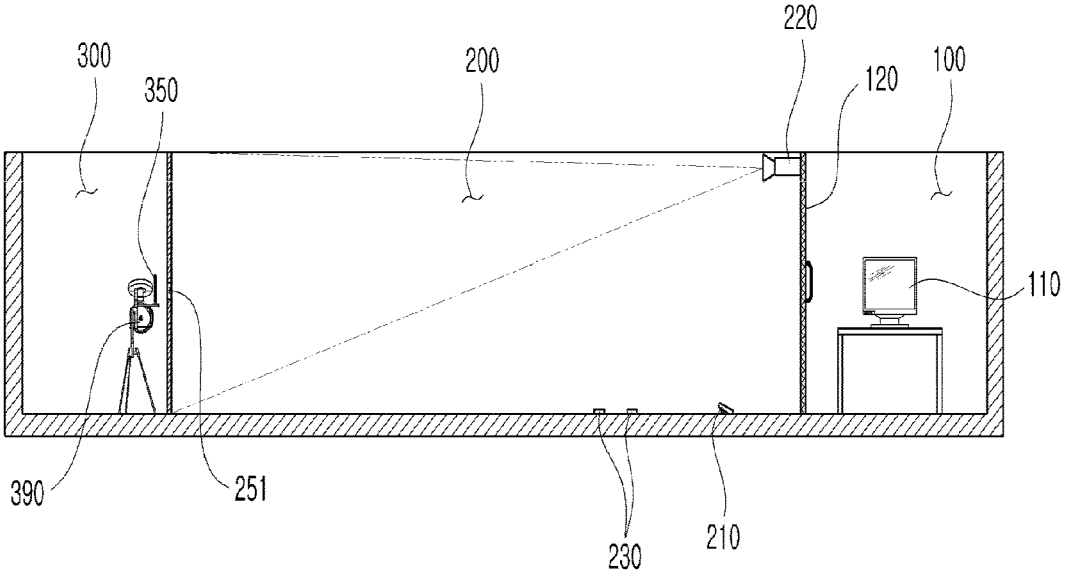
FIG. 5 is a sectional view for describing the screen baseball system, according to the present invention.

In the examples of FIGS. 4 and 5, the space of the screen baseball system is divided into a safety area 100, a game area 200, and a pitching area 300. Additional areas, such as, for a control unit (not illustrated) and the like, may be further included.

The control unit performs starting, progressing, and terminating the screen baseball game. Functions performed by the control unit include:

- Calculating a batting result of a user using the location and speed of the baseball. The location and speed may be sensed by a sensor 230, and transferred to the control unit. The control unit subsequently progresses the game.
- Operating an image unit 220 to project a game image, a first warning image, a second warning image, or the like.
- Operating a pitching machine 390, based on receiving a baseball shooting signal from a shooting signal device 210. The shooting signal device 210 may be operated by the user, the control unit, or combinations thereof.
- Determining whether a baseball has been shot from the pitching machine 390, based on the sensor 230 data.
- Operating the screen shutter 350 between the closed state and the open state.
- Determining whether the screen shutter 350 is in a closed state or an open state.

In the examples of FIGS. 4 and 5, the safety area 100 is distinguished from the game area 200 by a safety net 120. The safety net 120 protects a user in the safety area 100. The user may access a user terminal 110, located in the safety area 100. The user may perform various tasks, such as, starting, monitoring, or terminating the game via the user terminal 110.

If the user wants to enter the game area 200 from the safety area 100, the user may pass through a door 125, provided in the safety net 120. During the game, the door 125 should be maintained in a closed state to prevent a safety incident.

The game is performed in the game area 200. During play, a baseball is shot by the pitching machine 390, from the pitching area 300, into the game area 200. The user may then attempt to batt the baseball. Baseballs entering the game area 200 may be travelling at high speed. The user may additionally don protective equipment, such as a helmet, while in the game area 200.

In the examples of FIGS. 4 and 5, the game area 200 may include the shooting signal device 210, the image unit 220, the sensor 230, the screen 250, and the like. The game area 200 may additionally include a baseball collecting unit 205 having an inclined surface. The baseball collecting unit 205 collects the batted baseballs and allows the balls to be returned to the pitching area 300. The baseballs may be transferred to the Ditching area 300 manually or automatically.

The shooting signal device 210 is configured to allow the user to apply the baseball shooting signal to the control unit. When the user steps on the shooting signal device 210 and the screen shutter 350 is in the open state, a baseball is shot to the game area 200.

The image unit 220 receives image information from the control unit and projects an image onto the screen 250. The projected image may include, the game image, the first warning image, or the second warning image.

The sensor 230 senses the location and the speed of a baseball batted by the user and provides the sensed location and the sensed speed to the control unit. Various sensors 230, such as a camera sensor, (or a line sensor, a vision sensor, and or the like may be applied. The control unit calculates a batting result using a value sensed by the sensor 230 and transmits the calculated batting result to the image unit 220.

A screen hole 251 is located at the center of the screen 250. A baseball shot from the pitching machine 390, passes through the screen shutter 350, the screen hole 251, and moves toward the user within the game area 200.

The pitching area 300 is distinguished from the game area 200 by the screen 250. The pitching area 300 includes the screen shutter 350 and the pitching machine 390. The screen shutter 350 is located between the pitching machine 390 and the screen 250. The safety screen 358 closes the screen hole 251 while the screen shutter 350 is in a closed state.

Any suitable pitching machine 390 may be used to shoot the baseball.

Description of the Screen Shutter

Figure 6:
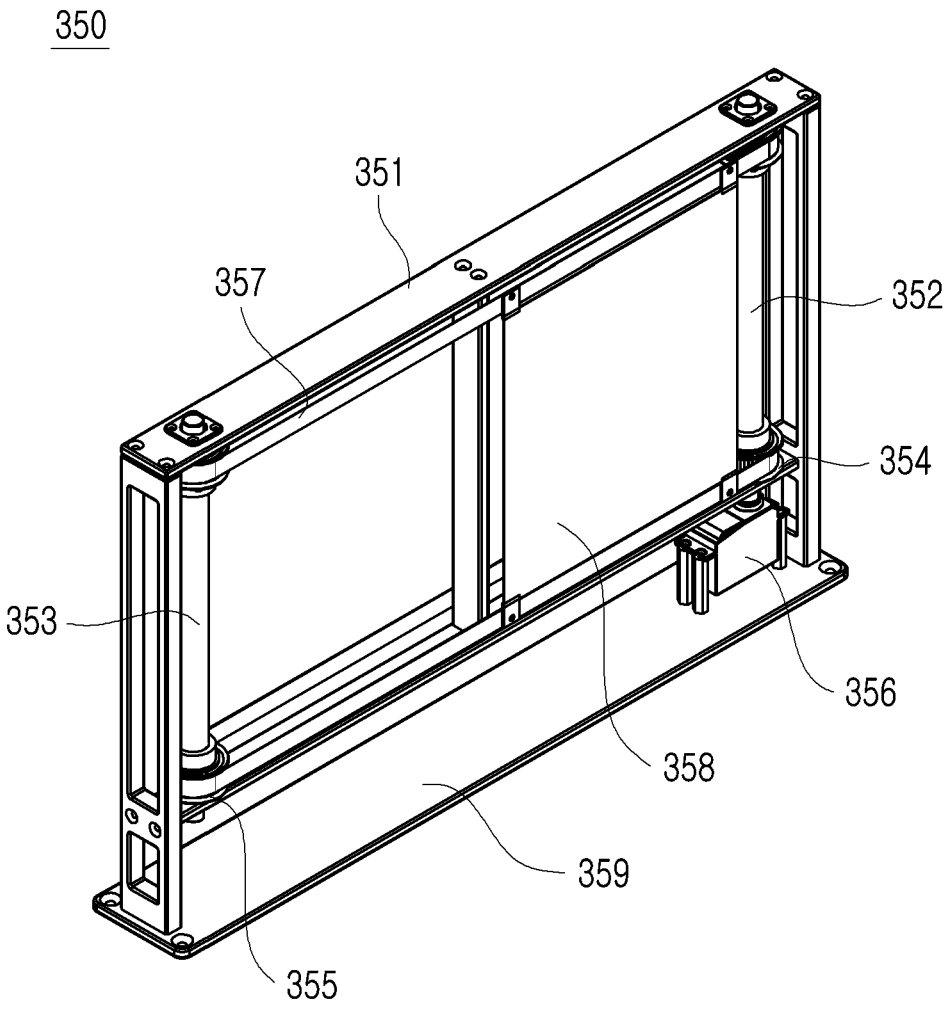
FIG. 6 is a perspective view for describing a screen shutter of the screen baseball system, according to the present invention.
Figure 8A:
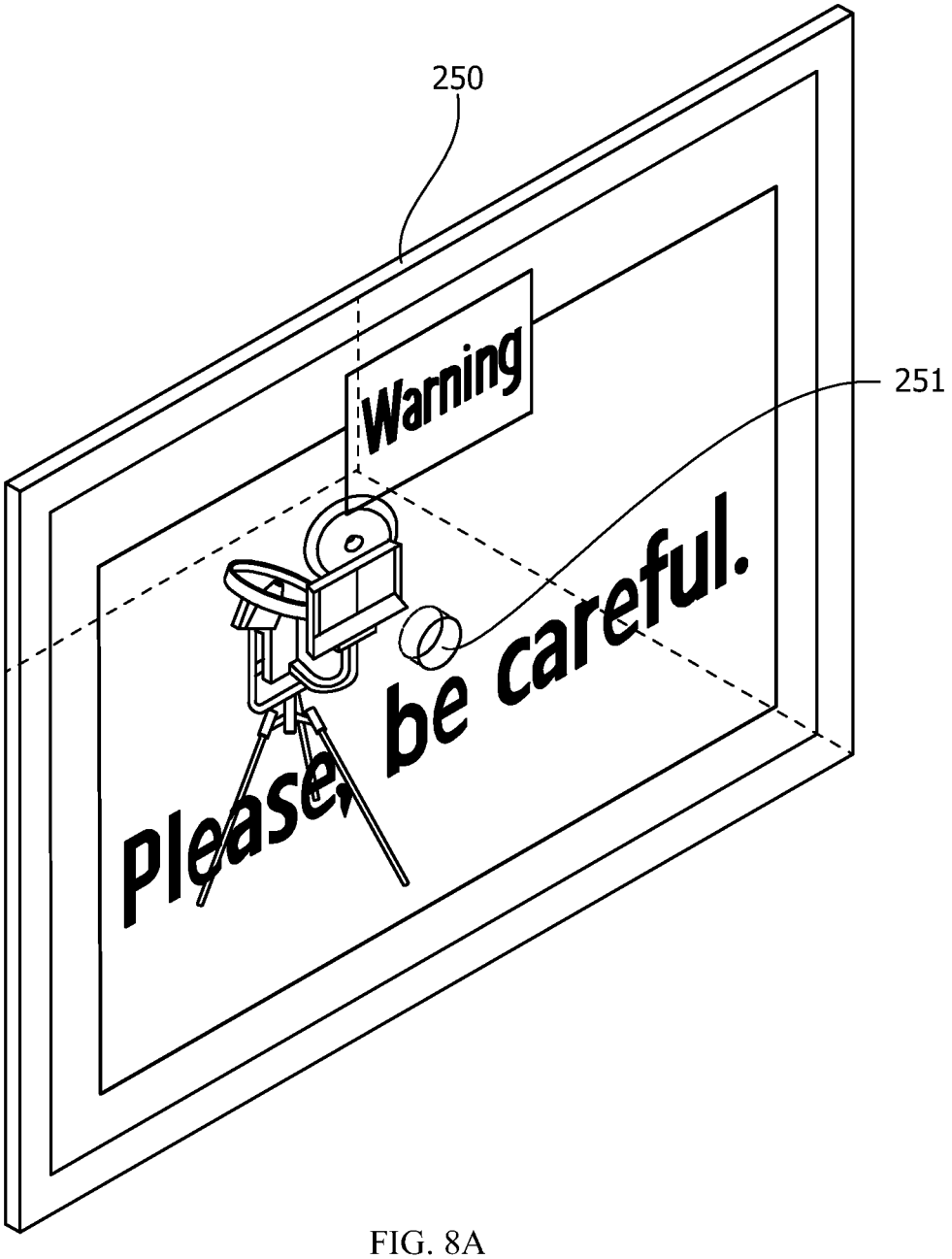
FIG. 8A illustrates a first warning image projected for the method for preventing a safety accident in the screen baseball system, according to the present invention.
Figure 8B:
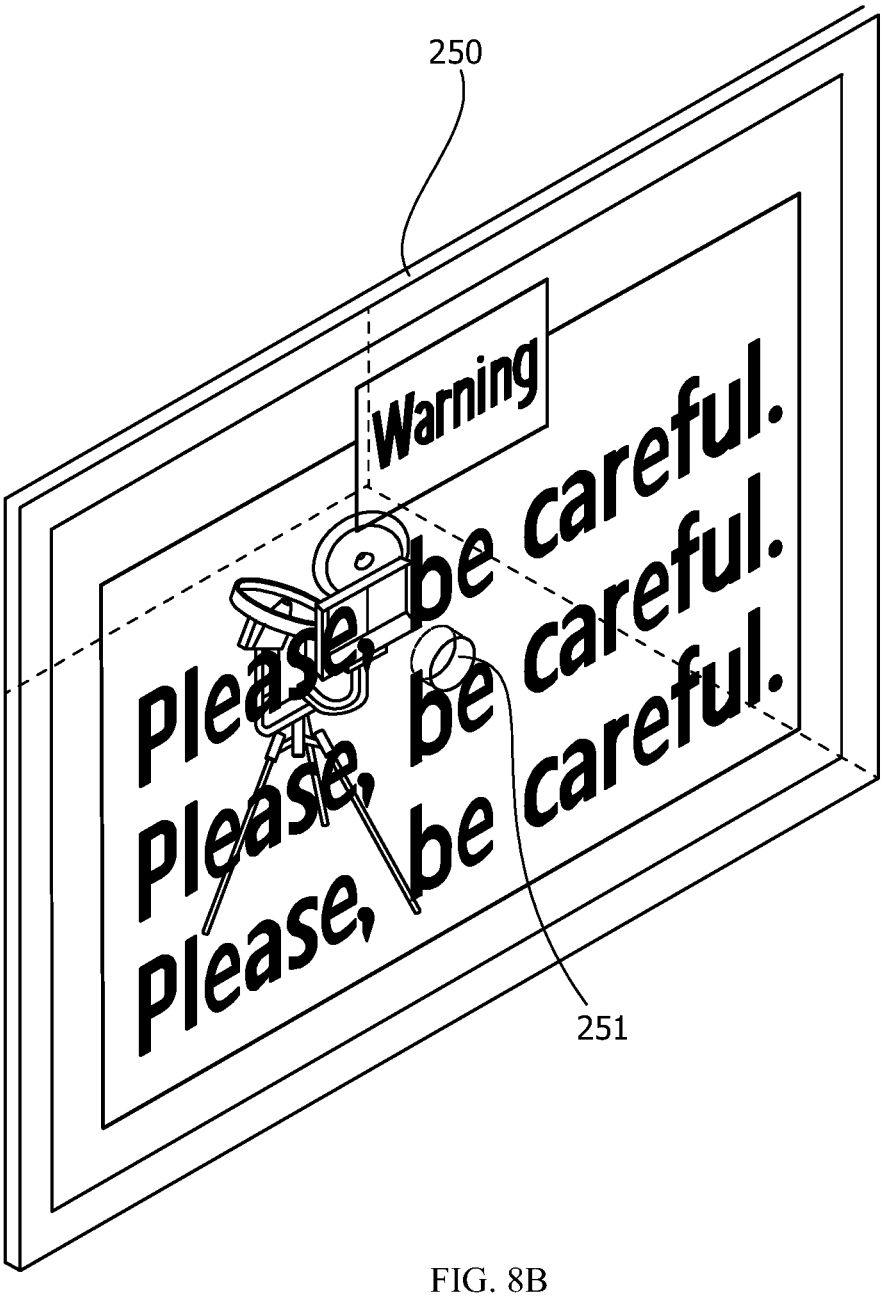
FIG. 8B illustrates a second warning image, according to the present invention.

The screen shutter 350 according to the present invention will be described in detail with further reference to FIGS. 6, 8A, and 8B.

The screen shutter 350 includes a frame 351, a first rotary shaft 352, a second rotary shaft 353, a first pulley 354, a second pulley 355, a driving part 356, a timing belt 357, a safety screen 358, and a holding part 359.

The first rotary shaft 352 and the second rotary shaft 353 are located on opposite sides of the inside of the frame 351, such that, the safety screen 358 is wound thereon.

The first pulley 354 and the second pulley 355 are coaxially coupled to ends of the first rotary shaft 352 and the second rotary shaft 353, respectively. The timing belt 357 is wound on the pulleys 354 and 355.

Accordingly, the timing belt 357 moves through rotation of one or more of the first pulley 354 and the second pulley 355. The safety screen 358 is affixed to the timing belt 357.

The safety screen 358 is configured to close the screen hole 251 and is formed of a material that may safely block a baseball shot at a high speed. The safety screen 358 moves by movement of the timing belt 357 and may be wound on one or more of the first rotary shaft 352 and the second rotary shaft 353.

The holding part 359 firmly affixes the screen shutter 350. The holding part 359 is located on the rear surface of the screen hole 251, and may be affixed to a separate affixing member affixed to the ground or may be affixed to the frame itself of the pitching machine 390.

The driving parts 356 drive one or more of the first pulley 354 and the second pulley 355. Although FIG. 6 illustrates that the driving parts 356 are located below the first pulley 354 to drive the first pulley 354, the driving parts 356 may be operated while being located below the second pulley 355. Preferably, a plurality of driving parts 356 may be provided. Thereby, when any one of the driving parts malfunctions, another driving part is available for operation.

The screen shutter 350 may be maintained in any one of the closed state and the open state. The screen shutter 350 may be automatically or manually operated by the control unit.

The closed state is a state in which the screen hole 251 is completely closed by the safety screen 358. In this case, even when a baseball is shot from the pitching machine 390, the baseball is blocked by the safety screen 358, and thus, fails to arrive in the game area 200.

The opened state is a state in which the screen hole 251 is not closed by the safety screen 358, and thus, a baseball arrives in the game area 200 through the screen hole 251.

It is preferable that the screen shutter 350 is normally maintained in the closed state. The screen shutter 350 is operated in the opened state only when a baseball shot is desired. When a shot is desired, the user activates the shooting signal device 210 and applies the baseball shooting signal to the control unit. The screen shutter 350 is operated resulting in the open state in conjunction with the baseball shooting signal.

After the baseball has been shot, the screen shutter 350 may be returned to the closed state. After a predetermined period of time, the control unit operates the screen shutter 350 to return the screen shutter 350 to the closed state.

During operation, one or more of the pulleys 354, 355 is operated by the driving parts 356 and rotated by a predetermined angle. The driving parts 356 may be configured to rotate an operated pulley in a reverse direction or in a forward direction by the predetermined angle.

If the control unit detects a malfunction of the pitching machine 390, the screen shutter 350 may be immediately operated to place the screen shutter 350 in the closed state. For example, if the control unit fails to detect shooting of a baseball, after the application of the baseball shooting signal, to the pitching machine 390, the control unit may immediately operate the screen shutter 350 to place the screen shutter 350 in the closed state.

If the control unit detects a malfunction of the pitching machine 390, the control unit operates the image unit 220 to project the first warning image thereby warning the user of a potential for a safety incident. The control unit may separately operate the screen shutter 350, to place the screen shutter 350 in the closed state. An example of the first warning image is illustrated in FIG. 8A.

If both the pitching machine 390 and the screen shutter 350 have both malfunctioned. For example, when the control unit applies the baseball shooting signal to the pitching machine 390, fails to detect shooting of the baseball, and the screen shutter 350 is in the open state, the the danger of a safety incident is greatest.

In this case, the control unit attempts to operate the screen shutter 350 to place the screen shutter in the closed state. The control unit may attempt to operate a predetermined driving part 356 from among the plurality of driving parts 356. The control unit may additionally transmit an error message to the manager of the screen baseball game center. The control unit may also project an additional warning image to the user in the game area 200. For example, the control unit operates the image unit 220 to project the second warning image onto the screen 250. The second warning image is an image that performs warning at a level higher than that of the above-described first warning image. An example of the second warning image is illustrated in FIG. 8B.

Description of Method for Preventing Safety Accident

Figure 7:
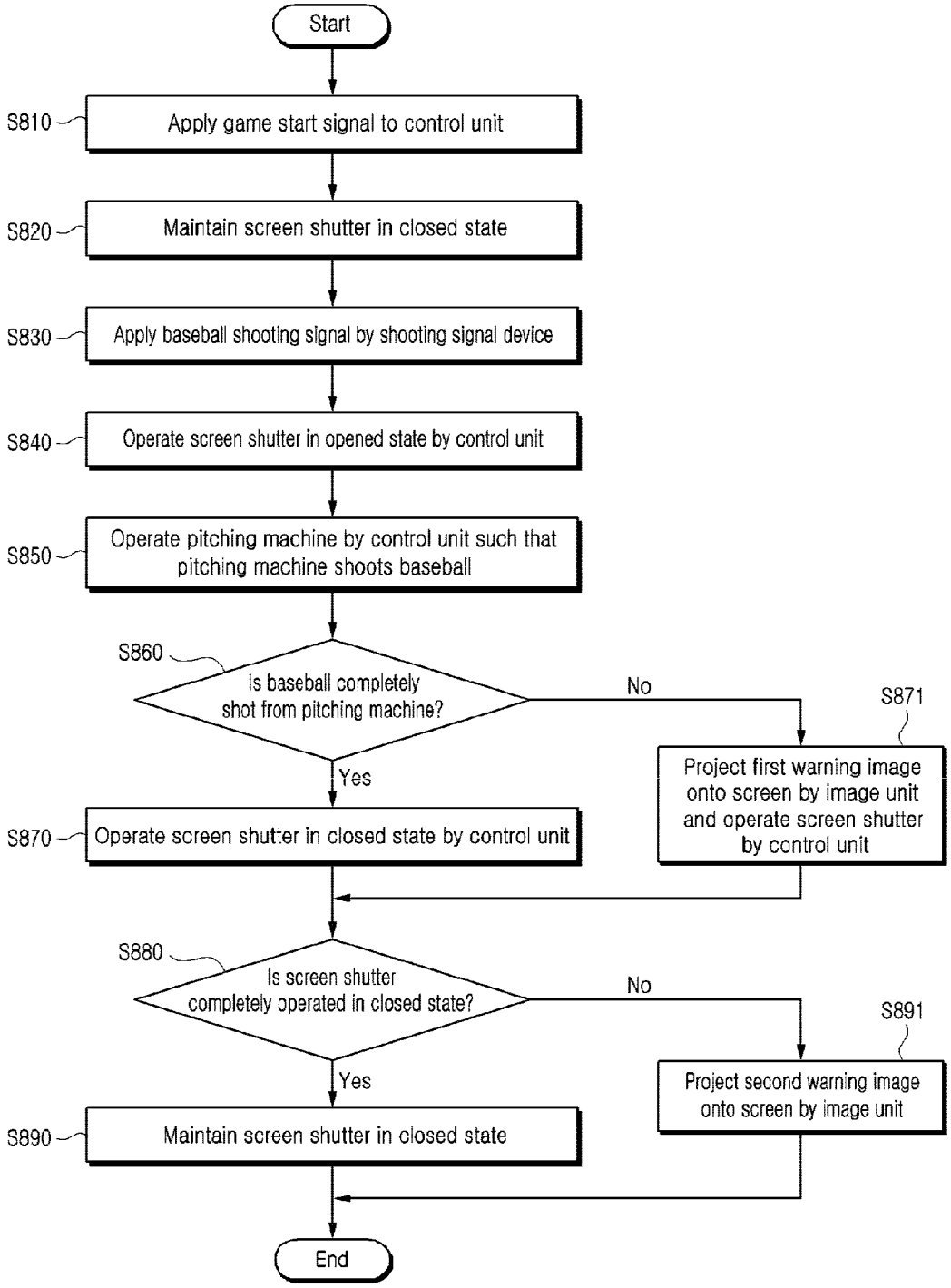
FIG. 7 is a flowchart for describing a method for preventing a safety accident in the screen baseball system, according to the present invention.

A method for preventing a safety incident in a screen baseball system, according to the present invention, will be described with further reference to FIGS. 7, 8A and 8B.

A game start signal is applied to the control unit, so that a screen baseball game starts (S810). The screen shutter 350 is maintained the closed state (S820).

The user steps on the shooting signal device 210, to apply a baseball shooting signal, to the control unit (S830).

The control unit operates the screen shutter 350, placing the screen shutter 350 in the open state. The control unit also operates the pitching machine 390, such that, the pitching machine 390 shoots a baseball (S850).

The control unit then detects whether the pitching machine 390 has successfully shot the baseball (S860).

If the pitching machine 390 has successfully shot the baseball, the control unit operates the screen shutter 350 to place the screen shutter 350 in the closed state. Alternatively, after a predetermined period of time, the control unit automatically operates the to place the screen shutter in the closed state (S870).

If the pitching machine 390 fails to successfully shoot the baseball, the probability that a safety incident may occur may increases. The control unit may immediately operate the screen shutter 350, to place the screen shutter in the closed state, prior to the predetermined period of time elapsing. The control unit also projects the first warning image (FIG. 9A) onto the screen 250 through the image unit 220 (S871).

The control unit identifies whether the screen shutter 350 is being operated in the closed state (S880). If the screen shutter 350 is operating normally, the screen shutter 350 is maintained in the closed state (S890), and the control unit waits for a next signal by the shooting signal device 210.

If the screen shutter 350 is not operating normally, the potential for a safety incident is high. In step S860, if a malfunction of both the pitching machine 390 and the screen shutter 350 is identified simultaneously, the potential of a safety incident is highest. The control unit In this case, the control unit attempts to operate the screen shutter 350 to place the screen shutter in the closed state. The control unit may attempt to operate a predetermined driving part 356. The control unit additionally transmits an error message to the manager of the screen baseball game center. The control unit also projects an additional warning image to the user in the game area 200. The additional warning may include the strong second warning image (FIG. 9B) (S891).

The system of present invention may find utility in additional sports in addition to screen baseball in which a ball is shot through a screen hole. For example, the present invention may also be used with softball, cricket, or tennis, to prevent a ball shot from the pitching machine from passing through the screen hole at a high speed.

Although an exemplary embodiment has been described in the above, it may be understood by those skilled in the art that the present invention can be variously modified and changed without departing from the spirit and the scope of the present invention, which are claimed in the claims. Further, a combination of one or more of the various embodiments should be also included in the scope of the present invention.

DESCRIPTION OF REFERENCE NUMERALS

100: Safety area
110: User terminal
120: Safety net
125: Door
200: Game area
205: Baseball collecting unit
210: Shooting signal device
220: Image unit
230: Sensor
250: Screen
251: Screen hole
300: Pitching area
350: Screen shutter
351: Frame
352: First rotary shaft
353: Second rotary shaft
354: First pulley
355: Second pulley
356: Driving part
357: Timing belt
358: Safety screen
359: Holding part
390: Pitching machine

The invention claimed is:

1. A screen baseball system comprising:
an image unit;
a pitching machine that shoots a baseball;
a screen that plays an image projected from the image unit and has a screen hole through which a baseball shot from the pitching machine passes;
a shooting signal device that applies a baseball shooting signal to the pitching machine through a control unit; and
a screen shutter that is provided between the pitching machine and the screen, comprises a safety screen that closes the screen hole, and is operated in conjunction with the baseball shooting signal applied from the shooting signal device;
wherein the image unit projects a first warning image onto the screen when the control unit fails to detect shooting of the baseball after applying the baseball shooting signal to the pitching machine, and projects a second warning image different from the first warning image onto the screen when the control unit detects that the screen shutter is in the opened state; and
wherein the screen shutter comprises:
a frame;
rotary shafts on which the safety screen is wound and which are located inside the frame;
a timing belt to which the safety screen is fixed;
pulleys that are coaxially coupled to an end of the rotary shafts and on which the timing belt is wound;
a holding part that fixes the frame; and
one or more driving parts that drive one or more of the pulleys,
wherein one or more of the driving parts are operated, thereby rotating one or more of the pulleys, so that the safety screen closes the screen hole.

2. The screen baseball system according to claim 1, wherein the screen shutter is operated in any one of a closed state and an opened state and the safety screen closes the screen hole in the closed state, wherein the screen shutter is operated in any one of the closed state and the opened state by the control unit.

3. The screen baseball system according to claim 2, wherein when the shooting signal device applies a baseball shooting signal to the control unit, the control unit operates the screen shutter in the opened state and operates the pitching machine such that the pitching machine shoots a baseball.

4. The screen baseball system according to claim 3, wherein the screen shutter is automatically operated in the closed state when a predetermined period of time elapses after the screen shutter starts to be operated in the opened state.

5. The screen baseball system according to claim 3, wherein the control unit detects whether the baseball is shot from the pitching machine, and when the control unit fails to detect shooting of the baseball after applying the baseball shooting signal to the pitching machine, the control unit operates the screen shutter in the closed state.

6. The screen baseball system according to claim 1, wherein when one or more of the pulleys are rotated by a predetermined angle, the driving parts rotate one or more of the pulleys in a reverse direction by the predetermined angle.

7. The screen baseball system according to claim 6, wherein the driving parts rotate one or more of the pulleys in the reverse direction by the predetermined angle, so that the screen shutter is automatically operated in the closed state when a predetermined period of time elapses after the screen shutter starts to be operated in the opened state.

* * * * *